United States Patent [19]

Heaslip et al.

[11] 4,391,319

[45] Jul. 5, 1983

[54] APPARATUS FOR INTRODUCING ELEMENTS INTO MOLTEN METAL STREAMS AND CASTING IN INERT ATMOSPHERE

[75] Inventors: Lawrence J. Heaslip, Toronto, Canada; Alphia L. Hohulin, Tremont; Joseph R. Mitchell, Peoria, both of Ill.

[73] Assignee: Keystone Consolidated Industries, Inc., Peoria, Ill.

[21] Appl. No.: 278,719

[22] Filed: Jun. 29, 1981

Related U.S. Application Data

[63] Continuation of Ser. No. 70,347, Aug. 27, 1979, abandoned.

[51] Int. Cl.[3] ..... B22D 35/04; B22D 11/10

[52] U.S. Cl. ..... 164/259; 164/57.1; 164/415; 266/207; 266/217

[58] Field of Search ..... 164/55.1, 56.1, 57.1, 164/259, 415, 473, 475; 266/200, 207, 216, 217; 75/53, 58, 129

[56] References Cited

U.S. PATENT DOCUMENTS

| | | | |
|---|---|---|---|
| 1,193,670 | 8/1916 | Davis | 164/57.1 |
| 2,353,657 | 7/1944 | Edwards et al. | 266/200 X |
| 3,089,767 | 5/1963 | Rinesch | 164/56.1 X |
| 3,224,051 | 12/1965 | Brown, Jr. et al. | 164/57.1 |
| 3,592,363 | 7/1971 | Stout et al. | 164/57.1 X |
| 3,702,151 | 11/1972 | De Blok et al. | 164/57.1 |
| 3,900,068 | 8/1975 | Gluma et al. | 164/415 X |
| 3,963,224 | 6/1976 | Pollard | 164/66.1 X |
| 4,010,938 | 3/1977 | Crudup | 266/216 |
| 4,210,048 | 8/1980 | Vanecer et al. | 164/259 X |

FOREIGN PATENT DOCUMENTS

| | | | |
|---|---|---|---|
| 2408368 | 8/1974 | Fed. Rep. of Germany | 164/55.1 |
| 2321847 | 11/1974 | Fed. Rep. of Germany | 164/57.1 |
| 1474697 | 3/1967 | France | 164/55.1 |
| 51-71827 | 6/1976 | Japan | 164/57.1 |
| 416150 | 7/1974 | U.S.S.R. | 164/55.1 |

*Primary Examiner*—Gus T. Hampilos

*Attorney, Agent, or Firm*—Allegretti, Newitt, Witcoff & McAndrews, Ltd.

[57] ABSTRACT

Aluminum pellets are ejected from the nozzle of an elongated tube into a stream of liquid steel flowing from a tundish into a continuous casting mold. Protective gas is utilized to propel the pellets of aluminum from the elongated tube into the molten stream. A special nozzle structure for the elongated tube insures that the aluminum pellets will properly impinge upon and mix with the molten stream. The elongated tube is retained within a larger cylindrical tube that directs low velocity, protective gas at the molten stream. The protective gas, such as nitrogen or argon, provides essentially nonreactive atmosphere that envelops the molten stream of steel.

4 Claims, 7 Drawing Figures

APPARATUS FOR INTRODUCING ELEMENTS INTO MOLTEN METAL STREAMS AND CASTING IN INERT ATMOSPHERE

This is a continuation of application Ser. No. 070,347 Aug. 27, 1979 now abandoned.

BACKGROUND OF THE INVENTION

This invention relates to an apparatus for adding alloy material to a molten metal stream in combination with apparatus for maintaining an envelope of protective atmosphere about the molten metal stream.

When casting billets of steel, for example, it is known that the addition of aluminum to the molten metal as an alloying agent will facilitate production of a fine grained steel product. Heretofore aluminum has been added to the molten metal in the ladle prior to discharge from a nozzle or port into a mold. Mixing of aluminum with steel by addition in the ladle does not always provide a uniform or homogenous cast product. Moreover, the addition of aluminum to a ladle, particularly in larger amounts, may cause blockage of discharge nozzles or ports. Finally, as much as 70% of the aluminum may be lost in the slag.

Another method of adding aluminum to a cast product is exemplified by Tinnes in U.S. Pat. No. 3,459,346. There it is disclosed that a wire of alloying material may be fed by action of rolls through a tube into a molten metal stream as that stream is being discharged from a ladle into an ingot mold. A problem encountered with such a wire feeding arrangement is that a blockage may form in the tube through which the wire is fed. That is, the wire will often melt and clog the feed tube thereby rendering difficult the control and efficiency with which the alloying wire is fed into the molten metal stream.

Still another method of adding alloying materials to molten metal during a casting operation is suggested in the May, 1979 issue of Modern Casting Magazine at page 26. There it is disclosed that a nozzle may be used to direct small amounts of innoculent materials directly into the stream of molten metal flowing from a ladle into a mold. In the disclosure, fine granules of ferro silicon and other elements are added to molten iron as the iron is tapped from a holding furnace and directed into a mold. The apparatus for this innoculation procedure includes a flexible hose which receives a low pressure air supply and a supply of the innoculent granules. The materials are transported through the hose to a discharge nozzle which directs the material into the stream of molten metal.

Even though an alloying material may be successfully added to molten metal, a problem still often encountered in casting processes, including continuous casting processes, is contamination of the cast material by oxygen. Oxygen contamination adversely affects grain size, macrocleanliness, microcleanliness and the mold solidification process. In an effort to counteract the deleterious effects of oxygen contamination, various procedures have been proposed for casting in inert atmospheres. One practice calls for enclosing the total casting operation within a container and controlling the atmosphere within that container. Mahin, in U.S. Pat. No. 3,467,167, discloses such a process as does Sindelar et al in U.S. Pat. No. 3,262,073.

Alternative processes include the procedure disclosed by Holmes in U.S. Pat. No. 3,439,735 wherein a shroud is positioned about the molten metal stream as the stream flows from the ladle to a casting mold. Inert gas is fed into the shroud and retained by the shroud about the molten metal stream. Pollard, in U.S. Pat. No. 3,963,224 discloses a similar mechanism. Likewise, Hildebrandt, et al in U.S. Pat. No. 4,102,386 and Coward in U.S. Pat. No. 4,084,799 disclose similar shroud mechanisms.

In the continuous casting of steel, the addition of alloying agents as well as the protection of the molten metal stream from oxygen contamination have not heretofore been satisfactorily and simultaneously accomplished. The present invention contemplates a new method and apparatus which provides for the addition of alloying agents to a molten metal stream in a protective gas atmosphere.

SUMMARY OF THE INVENTION

In a principal aspect, the present invention comprises apparatus for adding an alloy material to a molten metal stream while simultaneously providing a protective atmosphere envelope for the metal stream. The apparatus includes a gas carrying tube that directs a relatively low velocity supply of protective gas toward the molten metal stream. A separate alloy feed tube is positioned within the gas tube and receives pellets of alloying material for discharge into the molten metal stream. The pellets are directed into the molten metal stream by means of relatively high velocity protective gas which transports the alloying, pellet material directly into the molten metal stream and strips the stream of any oxygen gas which is attached to or surrounding the stream.

Thus it is an object of the present invention to provide an improved method for introducing alloy material into a molten metal stream.

Another object is to provide an improved method for adding alloy metal material to a molten metal stream while simultaneously maintaining the metal stream within a protective atmosphere.

One further object of the present invention is to provide means for adding an alloy material to a molten metal stream which will not become clogged, jammed or otherwise tend to fail.

Another object of the present invention is to provide a mechanism and method which provides improved protection of a molten metal stream with a gas during a continuous casting operation.

Still a further object of the present invention is to provide an improved apparatus and method particularly useful for continuous casting processes which permits the addition of an alloying material and simultaneously provides a protective gas envelope about the molten metal stream during the alloying operation.

One further object of the present invention is to provide apparatus for adding an alloying material to a molten metal stream which is economical, easy to use, highly reliable and extremely compact.

These and other objects, advantages and features will be set forth in the detailed description which follows.

BRIEF DESCRIPTION OF THE DRAWING

In the detailed description which follows, reference will be made to the drawing comprised of the following figures.

DESCRIPTION OF THE PREFERRED EMBODIMENT

Figure 1:
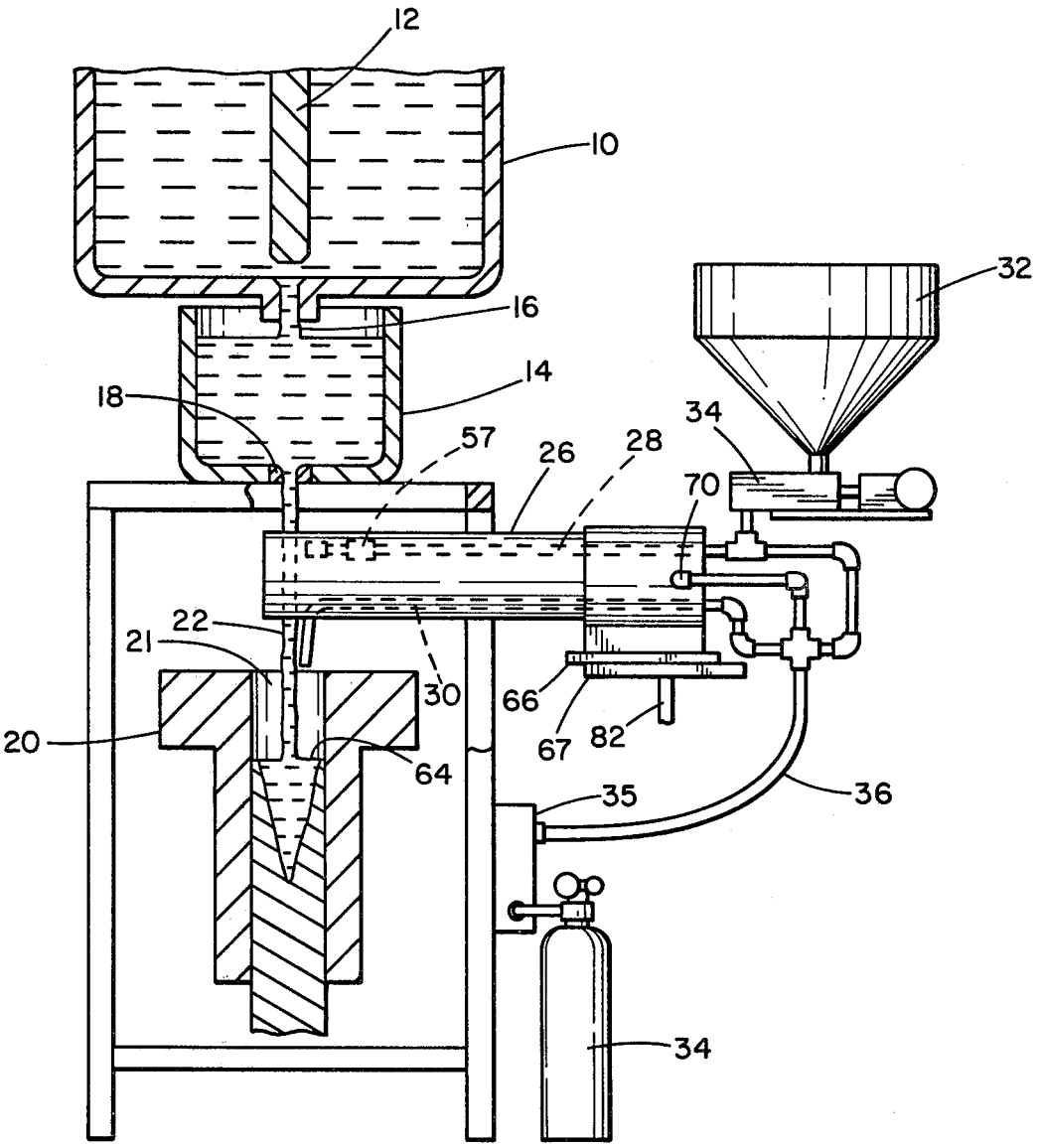
FIG. 1 is a side elevation of the improvement of the present invention in combination with a typical continuous steel casting apparatus.

FIG. 1 depicts a typical arrangement for a continuous steel billet casting operation which incorporates the improved apparatus of the present invention. A ladle 10 is filled with molten steel and is positioned over a tundish 14. The ladle includes a discharge port 16 which permits flow of molten steel into tundish 14.

The tundish 14 is an elongated trough with a plurality of tundish nozzles 18 arranged at strategic locations for discharge into individual molds 20. Each mold 20 is a continuous casting mold of the type known in the art. Generally, a plurality of these molds 20 are arranged side by side and each receives a stream 22 of molten metal. Each mold 20 then forms the billet during solidification into a generally square cross section of two by two to eight by eight inches.

The molten metal stream 22 flowing from a tundish nozzle 18 into a mold 20 descends due to gravity along a path normally in the range of 12 to 20" in length. The molten metal stream 22 fills the mold 20 to a level of approximately 4" below the top face or plate 24 of the mold 20. Thus, a region 21 is defined within the mold 20 above a fill line or level 64 of molten steel and below path 24. Normally this region 21 is occupied by air.

The apparatus and method of the present invention relate to the addition of alloy material to the molten stream 22 and the provision of a protective atmosphere within the area between the tundish nozzle 18 and the interior of the mold 20 including the region 21. The apparatus includes a relatively large, protective gas carrying tube or pipe 26 in the range of 3" to 10" in diameter. A relatively small diameter pellet discharge pipe 28 with a nozzle 57 is positioned within the tube 26. An optional small diameter, gas discharge pipe or tube 30 is also positioned within the pipe 26.

Alloying material in the form of pellets 56 is maintained in a hopper 32 and fed by a pellet feed mechanism 34 into the nozzle pipe 28. There pressurized gas from a gas supply source 34, which flows through a regular 33, flow meter 35 and supply hose 36, entrains the alloy material and impells it into the molten stream 22. Additional protective gas flows down tube 26 to form an envelope about the molten stream 22. A further protective gas flow through pipe 30 into the region 21 above the cast metal provides a protective gas envelope about the lower region of the molten metal stream 22 as it descends into the mold 20.

Advantageously, the tubes 28 and 30 are retained within the enlarged gas tube 26, though the tubes 28 and 30 may be positioned outside of the tube 26. Although it is possible to eliminate the function of any of the pipes or tubes 26, 28 and 30 by eliminating the part, the preferred embodiment, as illustrated, includes all of the pipes or tubes 26, 28 and 30 in the combination illustrated.

The relative velocity of gas flow in the tube 28 is greater than that within the pipe 26 and tube 30. Gas flow through the pipe 26 is generally lower to permit formation of an envelope of protective atmosphere about the molten metal stream 22. A higher gas velocity in tube 28 is required to impel pellets 56 of alloying material into the molten metal stream 22. The relatively high velocity gas stream issuing from tube 28 impinges forcefully upon the molten metal stream 22 and thereby provides means for removal of any oxygen bearing gas from the gas layer adjacent to the molten metal stream 22. The velocity of gas flow through tube 30 is adjustable in order to provide a desired atmosphere of protective gas within the region 21. This velocity is generally the same as that in tube 26.

Figures 2, 6, 7:
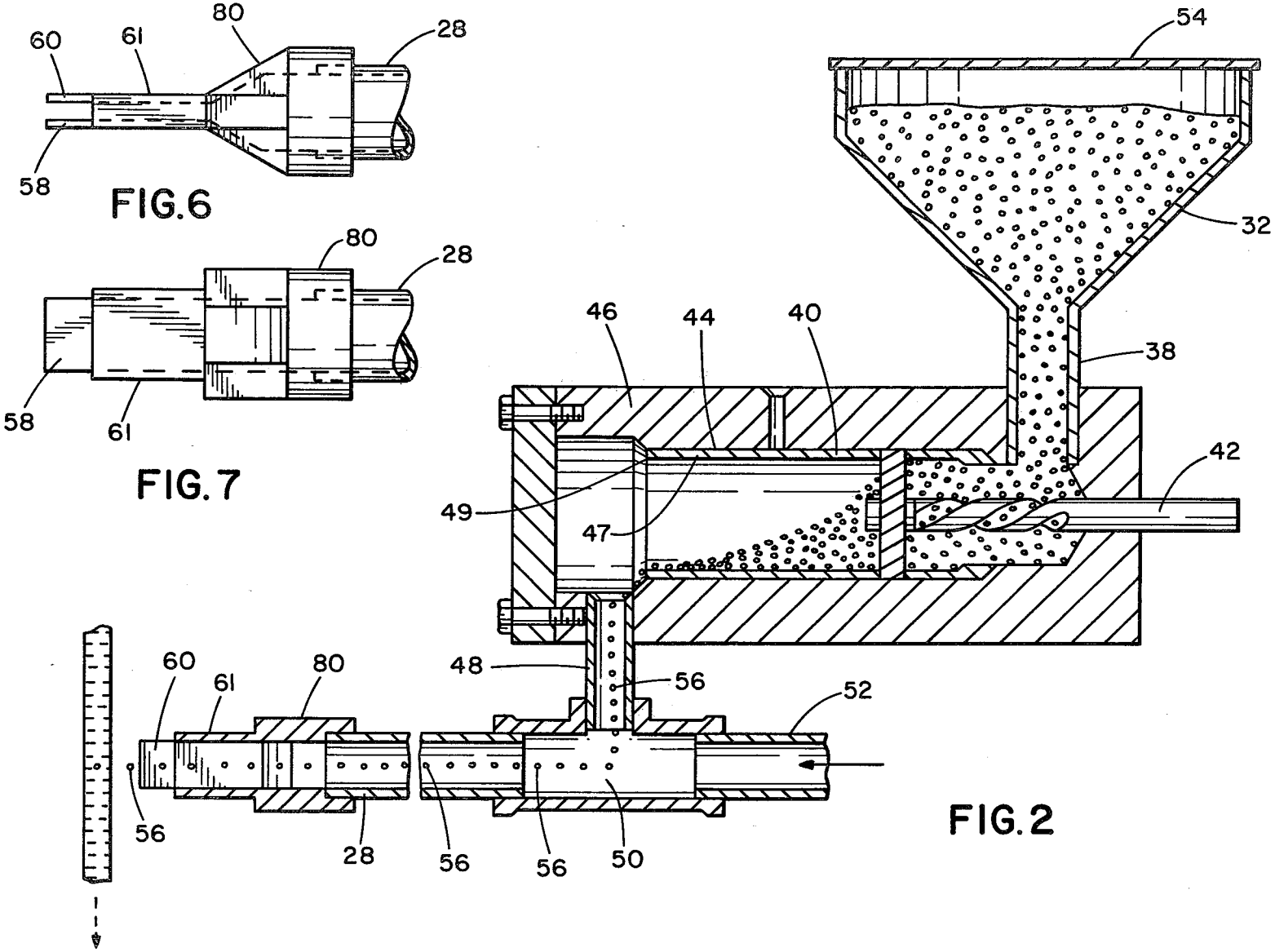
FIG. 2 is an enlarged side elevation in partial cross section of the improved pellet feed mechanism associated with the apparatus of the present invention.
FIG. 6 is a top plan view of the special nozzle assembly for pellet feeding.
FIG. 7 is a side elevation of the special nozzle assembly for pellet feeding.

Referring to the remaining figures, the structure of the alloy feed and protective gas apparatus is shown in greater detail. Referring to FIG. 2, the hopper 32 is conically shaped to facilitate feeding of alloying pellets 56, such as aluminum pellets through a bottom discharge tube 38 into a cylindrical feed tube 40. The feed tube 40 is mounted in a cylindrical bore 44 of housing 46 and is rotatably driven by a shaft 42. The tube 40 defines a generally regular cylindrical passage 47 maintained in a horizontal plane. Rotation of the tube or cylinder 40 transports and discharges alloying pellets through the open end 49 of tube 40 into a discharge channel 48 adjacent the end 49 of cylinder bore 44.

Channel 48 leads into a mixing chamber 50 connected to the nozzle delivery pipe 28. Protective gas, such as nitrogen, is provided through a gas inlet tube 52 to the chamber 50 where it entrains pellets 56 of alloy and directs them through the nozzle pipe 28 for discharge into the molten metal stream 22.

Note that the hopper 32 includes an airtight top plate 54 which maintains the feed mechanism under pressure and prevents the pressurized gas at inlet 52 from driving the alloying pellets upward through channel 48 and thereby clogging the system. Rather, the gas entering through inlet 52 is discharged through nozzle pipe 28.

The volumetric flowrate of gas entering chamber 50 is adjusted in accordance with the size of pellets 56 as well as the dimensional characteristics of the delivery tube 28. By proper empirical adjustment, the appropriate rate of pellet discharge is obtained. The speed of rotation of cylinder 40 and the pressure of gas at inlet 52 therefore are the variables controlled.

The delivery pipe 28 is sized to accurately control the flow of alloy material. Also, the end of the delivery tube 28 includes a special nozzle 57 which controls the dispersal pattern of pellets 56 discharged from the tube 28.

The nozzle 57 is comprised of 58, 60, 61 and 80. Vertical parallel side plates 58 and 60 are integral with the end of a discharge tube 61 that is connected to a transition housing 80. The plates 58 and 60 have a longitudinal dimension greater than their lateral spacing. The rectangular configuration of the inside surfaces of tube 61 is achieved by a smooth transition 80 from the delivery tube 28. The vertical inside dimension of tube 61 is the same as the inside diameter of tube 28. The spacing of side plates 58 and 60, and the lateral inside dimension of tube 61 are less than two times the mean diameter of the pellets 56 fed through delivery tube 28. The top and bottom spaces between plates 58 and 60 are open since control in the vertical direction is not as critical as lateral control of pellet discharge.

That is, the molten metal stream 22 may have a diameter of approximately 2". It is therefore important to discharge the alloying agent, such as aluminum pellets 56, directly into the center of the molten metal stream. If the pellets 56 are misdirected, they may strike a glancing blow against the stream and will not enter the stream. This would result in a loss of alloying material. With the special nozzle 57 described, it is possible to direct the alloying material directly at the center of the stream 22 with less than a ¼" spread to thereby cause the propelled pellets 56 to penetrate the stream 22 and enter the final cast product as an alloying agent. Tests have shown that with the nozzle construction of the present invention, the amount of alloying material which enters the molten product is greater than 99%. This is to be compared with the prior art method of the addition of material to the ladle in which only 30 to 70% of the material enters the final cast product.

With this described pellet feed system the range and accuracy of control of alloy feed through the delivery pipe 78 is extremely close and accurate. Additionally, because of the manner in which alloy is added to the molten stream, the amount of alloying material which is, in fact, included in the final molded product is greatly enhanced as compared with prior art methods. More than 90% of the alloying metal actually becomes part of the final molded product. Moreover, the alloying material is homogeneously dispersed through the molded product due to the manner in which it is added to the molded product.

Figure 3:
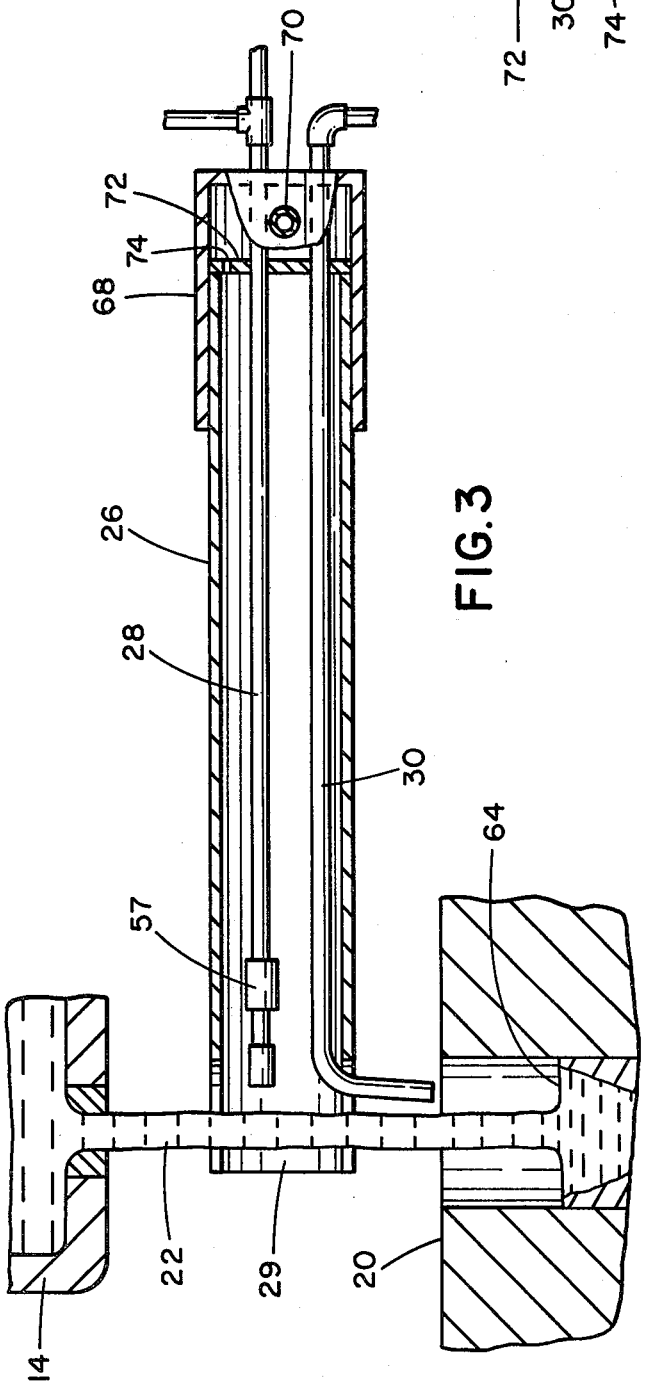
FIG. 3 is an enlarged side section of the low velocity protective gas tube which is incorporated as part of the apparatus of the present invention.
Figure 4:
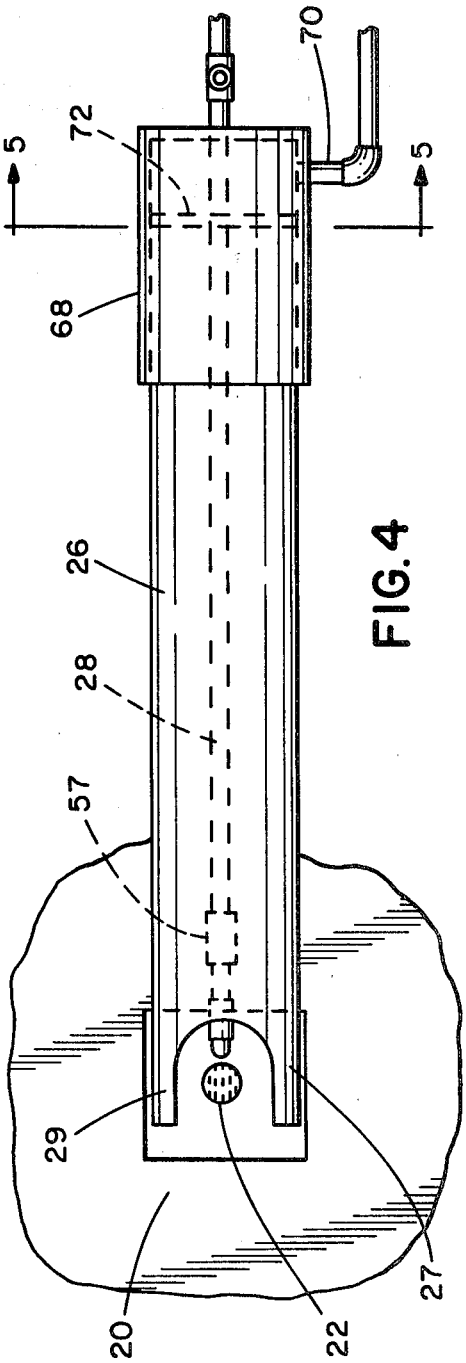
FIG. 4 is a top plan view of the apparatus shown in FIG. 3.

Another feature of the invention is illustrated by FIGS. 3 and 4. There it is shown that the tube 26 is formed with a semicircular arcuate end 62 which permits the pipe 26 to partially encircle the stream 22. Thus, the pipe 26 includes lateral side projections 27 and 29 which may partially encircle the stream 22. In this manner, generally low velocity protective gas, such as nitrogen or argon, which flows through the tube 26 can more completely envelop the molten stream 22. The velocity of the stream 22 tends to entrain protective gas flowing from the tube 26 to thereby accentuate the protective aspects of the gas. To further accentuate the protective gas envelope about the molten stream 22, the auxiliary gas tube 30 is provided to discharge inert gas directly into the region 21 of mold 20 just above the fill line 64 in the mold 20. It has been determined that providing protective gas in this region directly above the fill line 64 is highly desirable.

Figure 5:
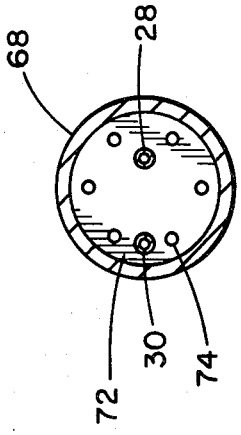
FIG. 5 is a cross sectional view taken along the line 5—5 in FIG. 3 of the diffuser plater assembly associated with the gas tube for the apparatus of the present invention.

In practice, the tube 26 is mounted on an adjustable platen 66 slidably mounted on a plate 67 which is, in turn, on a pivot shaft 82 as shown in FIG. 1. Alternatively, the tube 26 may be telescopically mounted within a cylindrical support 68 as shown in FIG. 3. Protective gas flows through inlet 70 to the cylinder 68 and is diffused through a plate 72 as shown in FIGS. 3 and 5. Diffuser plate 72 has variously sized openings 74 arranged in a pattern to diffuse the protective gas in the pipe 26 and facilitate flow down the pipe so as to envelop the molten stream 22. Generally speaking, the gas velocity in the pipe 26 is low so that the envelope of protective gas about the stream 22 is maintained.

It is possible to vary the structure and arrangement of component parts comprising the invention. For example, it is possible to eliminate any of the pipes or tubes 26, 28 and 30 along the elimination of their functions. These components may also be repositioned. Pipe 28 may, for example, be external tube 26.

In the preferred embodiment, however, all of these pipes and tubes are retained to provide a protective gas atmosphere for protection of the molten stream and to also provide a means for adding particulate alloying material to the molten metal stream. It has been found that the addition of alloying agents in small amounts continuously, greatly facilitates the success of the casting operation and also facilitates total usage of the alloying agent. Minimal amounts of the alloying agents are lost through slag or through failure to enter the molten product. The apparatus and method also have application to systems other than continuous casting or steel casting systems. As another alternative, multiple nozzle feed pipes 28 or gas flow pipes 30 may be used separately or within a single gas tube 26. Thus, while there has been set forth a preferred embodiment of the invention, it is to be understood that the invention is to be limited only the following claims and their equivalents.

What is claimed is:

1. In a casting system including a casting mold and a tundish arranged above the casting mold, the improvement of apparatus for adding an alloy material to a molten metal stream flowing form the tundish into the casting mold comprising in combination:

a hollow tube generally extending in a horizontal direction, said tube having a closed end and an open end; means associated with the hollow tube for positioning the open end of the hollow tube between the tundish and the casting mold and adapted to be in opposed relation to and on one side of a molten metal stream and for maintaining the tube generally transverse to a direction of travel of a molten metal stream from the tundish to the casting mold;

means associated with the closed end of the hollow tube for supplying inert gas to said hollow tube for discharge from the open end toward and around a molten metal stream, said open end being unblocked to permit visual observation of a molten metal stream on a side opposite the open end;

means mounted in the hollow tube to reduce the velocity of the inert gas suppled to the hollow tube to produce a low velocity gas exciting the open end of the hollow tube;

an alloy feed tube positioned within the hollow tube, said alloy feed tube including an inert gas inlet, and alloy inlet for receiving pellets of alloy material and a discharge nozzle arranged at the open end of the hollow tube and having an outlet directed toward the open end of the hollow tube;

means associated with the alloy feed tube for supplying a mixture of alloy material and inert gas at a relatively higher velocity then the velocity of said low velocity gas to the alloy feed tube;

a gas feed tube in the hollow tube having an outlet at the open end of the hollow tube, said outlet being arranged to direct inert gas toward said casting mold; and means in the alloy feed tube for directing the alloy pellets by flow of said relatively higher velocity inert gas into the molten metal stream simultaneous with the low velocity inert gas flow which envelopes the molten metal stream.

2. The apparatus of claim 1 wherein the alloy feed tube comprises an elongated tube member with a discharge nozzle, said nozzle being shaped to control lateral dispersion of alloy material.

3. The apparatus of claim 2 wherein the nozzle has a lateral dimension less than two times the maximum diameter of pellets ejected from the nozzle.

4. The apparatus of claim 2 wherein the nozzle has a lateral dimension less than the longitudinal dimension.

* * * * *